United States Patent [19]

Vogel

[11] 4,434,839

[45] Mar. 6, 1984

[54] PROCESS FOR PRODUCING METALLIC SLURRIES

[75] Inventor: Alfredo Vogel, Malvern, England

[73] Assignee: Secretary of State in her Brtannic Majesty's Government of the United Kingdom, London, England

[21] Appl. No.: 407,481

[22] Filed: Aug. 12, 1982

Related U.S. Application Data

[63] Continuation of Ser. No. 96,414, Nov. 21, 1979, abandoned.

[30] Foreign Application Priority Data

Nov. 27, 1978 [GB] United Kingdom ..... 46197/78

[51] Int. Cl.[3] ..... B22D 11/124; B22D 11/10; B22D 1/00

[52] U.S. Cl. ..... 164/485; 164/122; 164/133; 164/337; 164/440; 164/490; 164/900

[58] Field of Search ..... 164/485, 488, 489, 490, 164/440, 122, 122.1, 122.2, 125, 126, 128, 133, 337, 900

[56] References Cited

U.S. PATENT DOCUMENTS

| | | | |
|---|---|---|---|
| 1,671,446 | 5/1928 | Paulus | 138/38 |
| 1,770,208 | 7/1930 | Kemnal | 138/38 X |
| 2,371,604 | 3/1945 | Brennan | 164/490 |
| 2,565,959 | 8/1951 | Francis et al. | 164/440 X |
| 3,391,051 | 7/1968 | Ehrenfreund et al. | 264/48 X |
| 3,587,718 | 6/1971 | Hopkins | 164/440 |
| 3,751,009 | 8/1973 | Archer | 366/337 |
| 3,773,098 | 11/1973 | Rock | 164/133 X |
| 3,875,991 | 4/1975 | Korshunov et al. | 164/502 |
| 3,902,544 | 9/1975 | Flemings et al. | 164/71.1 |
| 4,194,552 | 3/1980 | Bennett | 164/71.1 |

FOREIGN PATENT DOCUMENTS

| | | | |
|---|---|---|---|
| 51-38237 | 3/1976 | Japan | 164/133 |

*Primary Examiner*—Gus T. Hampilos
*Assistant Examiner*—J. Reed Batten, Jr.
*Attorney, Agent, or Firm*—Stevens, Davis, Miller & Mosher

[57] ABSTRACT

In a method for forming shaped articles from molten metallic material the melt is caused to flow from a holding vessel therefor through a refractory duct having at least one static thermally-conducting element extending transversely within the duct so dimensioned and located to both cool and stir by shear the melt flowing therethrough. The melt is cooled to a temperature within its freezing range, if it is an alloy, or at its freezing point, if it is a metal, and is stirred to precipitate a solid phase as fragmented dendrites. The cooled and stirred metal outflow from the duct is cast into shaped articles. The invention has one specific application in producing the precipitating solid phase as non-degenerate micro-crystalline particles.

5 Claims, 2 Drawing Figures

1
2
3
4
4A
5
6
7
8
9
10
11
12
13
14
15
16
16'
17
18
19
20
II
II

PROCESS FOR PRODUCING METALLIC SLURRIES

This is a continuation of application Ser. No. 96,414 filed Nov. 21, 1979, and now abandoned.

The present invention relates to an apparatus and process for cooling a flow of a molten material which is to be directed to a means for casting the material.

It is common practice in casting processes that the molten material is kept at a temperature which is well above its melting point or liquidus temperature as the case may be in order to ensure that the material does not solidify prematurely on its way to the mould or other casting apparatus. As a result of this practice, a considerable degree of superheat has to be extracted from the material as well as the latent heat of freezing, so the solidification process tends to be slow. This leads to relatively low throughputs for the casting apparatus, coarsening of the grain structure, and since cooling in a mould or the like takes place through the walls, to an inhomogeneous cooling process with consequentially inhomogeneous properties in the casting which is eventually obtained.

It is an object of this invention to mitigate these problems of the prior art casting processes by providing a method for rapidly and controllably cooling a molten material. Accordingly the present invention provides a process for cooling a flow of a molten material in a controlled manner, wherein the flow of molten material is simultaneously subjected to a stirring action which is such that the temperature of the material is substantially the same at any point in any one plane perpendicular to the direction of the flow. The invention further provides apparatus for cooling a flow of a molten material in a controlled manner which comprises means for cooling the flow and means for simultaneously stirring the flow in such a manner that the temperature of the material is substantially the same at any point in any one plane perpendicular to the direction of the flow. Preferably the apparatus includes a duct through which the flow of molten material may be directed and the means for cooling and for simultaneously stirring the flow comprise at least one element extending transversely within the duct. The apparatus may be used in conjunction with any delivery means for the molten material and with suitable casting means, for example, a series of ingot moulds or a continuous casting machine.

The process and apparatus of this invention are of especial application to the casting of materials which exhibit a freezing range of temperatures, for example metallic alloys, mixtures of plastics materials and waxes. Most generally, materials as they solidify from the molten state pass through a condition in which solid and liquid phases co-exist. For materials which have a sharply defined melting point this condition occurs at this melting point whilst for materials which exhibit a freezing range of temperatures a mixture of solid and liquid material occurs throughout this temperature range, ie at all temperatures between the liquidus and the solidus temperatures. If then a body of material in a fully molten state, ie at a temperature above the liquidus or above its freezing point as the case may be, is allowed to cool to the liquidus or freezing temperature, solid material will commence to form and will continue to form until the whole body has solidified. Where the material exhibits a freezing range of temperatures complete solidification occurs when the temperature of the whole body of material reaches the solidus. Where the body of material is undisturbed solid will form at its periphery from which loss of heat takes place, so that, for example, when the molten material is introduced into a mould, solid begins to form at the walls of the mould and extends gradually inwards therefrom as heat is extracted through the walls. By appropriate stirring of the solid/liquid mixture in the freezing range, the solid which forms can be obtained as a dispersion of discrete particles suspended in a matrix of the molten (liquid) material. Such a dispersion of solid phase in liquid phase is, in the case of a metallic material which exhibits a freezing range of temperatures, termed a "metallic slurry" and such dispersions demonstrate advantageous properties.

In particular, because the slurry is more viscous than a fully molten material, it is more easy to handle and less liable to splashing and turbulence on pouring for casting, with the result that the casting produced is less likely to incorporate air and will on this account be sounder. Furthermore metallic slurries are of great advantage as intermediate products since they can have thixotropic properties which are recreated when the fully solidified material is reheated to just within the freezing range. In this state the material has a solid skin and can be treated very much as if it were still fully solid to that handling of the material is relatively straightforward, but at the same time it will flow readily when subject to an applied shearing force. The material in this condition is therefore most suitable as a feed for a pressure die casting process and since it does not need to be heated up to a temperature at which it is fully remelted both a saving in energy and a reduction in wear and tear on the die casting apparatus are achieved.

It has therefore been conventional practice in producing metallic slurries to cool a fully molten metallic material to its freezing point or to within its freezing range as the case may be, so that solid forms and then to stir the liquid/solid mixture vigorously for an extended period of time. In this way a slurry is produced in which the solid material takes the form of so-called "degenerate dendrites" which are essentially fragments of the dendritic primary solid formed as the liquid was cooled and broken up by the stirring process. Because of the long standing time and the vigorous stirring which increases the effective rate of solute transport, the particles in the prior art slurry coarsen as stirring proceeds, ie grow fewer in number but larger in size. Not only therefore is the prior art process for producing metallic slurries relatively long and slow but it leads to castings with a relatively coarse microstructure and having on that account somewhat inferior physical and mechanical properties, particularly in that a solid with a coarse microstructure exhibits a poor heat treatment response.

The present process and apparatus are readily applicable to the production of metallic slurries and their use will mitigate some or all of the aforementioned problems of the prior art slurry forming and casting methods whilst retaining to as great a degree as possible the aforementioned advantageous properties of metallic slurries.

Accordingly the present invention provides, in one particular aspect, a process for forming shaped articles from a molten material which comprises causing the material to flow from a holding vessel in which the material is fully molten into a slurry making duct having at least one element extending transversely within the duct for cooling the molten material flowing through the duct to a temperature within its freezing range or at its freezing point as the case may be and for stirring the material to a sufficient degree at least substantially to prevent the formation of solid material on surfaces within the duct and directing the cooled material after passing through the duct to means for forming shaped articles therefrom.

According to a further aspect the invention provides apparatus for forming shaped articles from a molten material which comprises a vessel for holding the material at a temperature at which it is fully molten and having an outlet; means to control the outflow of molten material through said outlet and to direct said outflow; a duct arranged to receive said outflow at one end thereof and having at least one element extending transversely within the duct for cooling and for stirring material flowing therethrough; and means for forming shaped articles from material which has passed through the duct.

In a yet further aspect the invention provides shaped articles or slurry cast material made by the process of the invention. The shaped articles may in particular be bars suitable for use as feed for a die casting machine.

The process of the present invention has as its primary aims the relatively rapid extraction of heat from a flowing mass of the molten material which is to be treated and the simultaneous imparting of a degree of turbulence to the flowing mass which is sufficient to ensure that the cooling of the flow is homogeneous along the length of the duct. Also the turbulence should be such as to ensure, in the slurry-making mode, that solid is formed in the mass as a relatively large number of relatively small particles having a small interparticle spacing and not as relatively large particles. At the same time the turbulence imparted should not be so great as to cause the formation of crystals of solid having a degenerate microstructure. In slurry making, by causing the solid phase to form in such a turbulent situation small non-degenerate particles result and as the cooling is rapid this desirable micro-crystalline structure is retained through to the fully solidified state, ie there is insufficient time for coarsening of the structure to occur. At the outlet from the duct the solid phase typically constitutes from 30 to 65% by volume of the slurry and will generally have a relatively high viscosity. A fully solidified material is produced in the succeeding casting means by the extraction of the remaining latent heat of fusion of the material.

To assist in achieving substantially homogeneous cooling of the flowing mass as it moves along the duct it is preferred that the walls of the duct be constructed from an insulating material and where the material which is being treated is metallic it is convenient to use a refractory ceramic material such as the GC 50 material of the Carborundum Co for the walls of the duct. At the same time the cooling elements should be made of a material having high heat conductivity eg a metal or graphite. By using materials for the duct and elements of markedly differing conductivity it is possible to concentrate virtually all the cooling effect from the cooling elements and in this way not only can the whole of the flow be uniformly cooled but also the actual amount of heat abstracted from the flow can be very precisely controlled. This latter feature is particularly important in that it is obviously most desirable to avoid overcooling the material which might cause it to solidify prematurely in the duct rather than in the casting means. Such premature solidification is an especial danger in the case where the material is being supplied to a continuous casting machine since this tends to draw heat out of the material ahead of it, ie from the material which is still in the duct due to the chilling effect of the casting machine cooler. This problem also means that the process of the invention is most suitably applied to materials which exhibit a freezing range of temperatures.

A further great advantage of the process of this invention is that the stirring of the flow is achieved without the use of moving machinery. The design and successful operation of mechanical stirrers in the extreme conditions imposed particularly by the treatment of molten metals is very difficult to achieve and the realization that passive stirring means can be employed is a discovery of considerable value in this art.

The cooling element is most conveniently in the form of a rod of a high thermal conductivity material. The material preferably also has high erosion resistance especially where the material being treated is metallic: graphite is a suitable material for the cooling rod in these cases. The rod will generally extend across the duct at right angles to the axis thereof and may extend outside of the duct in order to provide external cooling surfaces from which heat extracted from the flowing metal within the duct can be shed to the outside. For this purpose the rod may have associated means outside the duct such as fins or vanes for the shedding of heat or alternatively it may be in the form of a heat pipe or may be hollow to provide a passage-way for the circulation therethrough of a coolant such as air or water.

In fitting a cooling rod into the duct it will generally be convenient to drill a pair of aligned holes through the wall of the duct through which a cooling rod can be passed across the duct. The rod is then cemented to the wall of the duct by use of a hardenable cement. In the case where metals are to be treated a refractory cement such as LDS (Carborundum Co) is most suitably used. A plurality of cooling elements may be provided and may be arranged to lie at angles to one another when in position in the duct, in order to produce a required degree of turbulence in the molten material flowing along the duct when the apparatus is in use.

The number of cooling elements will be chosen to give the required degree of cooling, taking into account the cooling capacity of each rod, and the amount of heat which must be extracted from the molten material. This latter is determined by such factors as the temperature of the material as it is fed into the duct, the flowrate of the material, the freezing temperature range values of the material, the latent heat of solidification of the material, its specific thermal capacity and of course whether or not it is required to cool the material to just above its freezing point or solidus temperature or to produce slurry from the material. The number and dimensions of the cooling elements in conjunction with such parameters as the dimensions and inclination of the duct and the flowrate and viscosity of the material being treated will also determine the shear rate to which the flowing material will be subjected and it may be necessary in some cases to make a compromise between the cooling effect and the shearing effect of the cooling elements. Alternatively, there may be present in the duct additional elements which have no cooling effect but which add to the shearing effect of the cooling elements which are already in place in the duct.

The cooling duct may be formed as a single entity into which cooling elements can be fitted in the appropriate positions for the intended use of the tube, or alternatively the duct can be built up as required for a given use from a series of standard, interconnectable cylindrical parts, some or all of which may possess in-built cooling elements. By so constructing the duct from standard items the same parts can be re-assembled to form ducts of different length or with different numbers or types of cooling element if requirements change. Considerable flexibility is thereby introduced, and additionally access for cleaning or repair when required is enhanced since the duct can be readily dismantled to its component parts.

The molten material which is to be cooled or converted to slurry is preferably held in an insulated vessel which may have a heater so that the charge of material within it can be maintained at a suitable temperature. Ideally in theory the temperature of the material should be just in excess of its freezing point or of the top limit of its freezing range, ie just above the liquidus temperature where the material exhibits a freezing range, but as it is difficult to keep a large body of material at a uniform temperature, especially a high one where the material is metallic, and to avoid any danger of the material solidifying in the vessel or even more seriously in the outlet leading to the cooling duct it is often necessary to maintain the material at a temperature which is 30° C. or more in excess of the liquidus temperature or freezing point. Furthermore keeping the molten material well above its liquidus temperature will help to prevent "sludging" ie the gathering of impurities at the bottom or top of the melt.

Control of the flowrate of material from the holding vessel may be effected simply by the provision of a relatively narrow outlet from the holding vessel. Alternatively a valve may be used to control the outflow of the molten material to the duct. Where a throttling connecting pipe is used and particularly when the material in the holding vessel is at a temperature which is not greatly in excess of its freezing point or liquidus temperature as the case may be, then the connecting pipe should preferably be as short as possible and may be insulated or even heated in order to ensure that the material does not tend to solidify within it.

It is convenient during a casting run to maintain the flowrate constant so that the cooling duct may operate under steady state conditions, as this ensures that the output from the duct is homogeneous with time, and that a consistent cast product is obtained. To do this it may be convenient to arrange that the vessel for the molten material provides a constant head of material. This may be done either automatically such as by provision of a weir or by a controlled pour of material from a relatively large vessel into a smaller header vessel, or by providing a suitable pump which works at a steady rate. A pump is particularly appropriate for use where the desired flowrate could only be met by providing a very large head of molten material which may be physically inconvenient. The cooling duct may be arranged to lie vertically or horizontally or at any intermediate inclination as is convenient considering the working space and height available.

After passing through the duct the cooled material may be led immediately into a fixed mould of a conventional kind for the material being cast or into the "cooler" die of a continuous casting machine from which it is withdrawn as a solid bar or rod in the conventional manner.

The combined stirring and cooling of the melt in the cooling duct when sufficient to form a slurry therein results in a significant proportion of the latent heat in the material being removed without the possibility for large dendritic crystals to grow so that where the initial temperature of the melt is properly controlled there will be a large number of small particles of solid material created in the melt. As a result of this removal of heat from the material before it enters the mould or die, the material once it has entered the mould or die cools rapidly to give a solid which has a fine equiaxed grain structure. Not only does this lead to an improved product but also the use of the cooling duct effectively as a means for cooling a molten material in advance of its passing into the casting apparatus enables that apparatus to achieve a much higher throughput of material than is possible when the supply to the casting apparatus is fully molten as is conventional.

An embodiment of apparatus according to the invention and suitable for the casting of metallic materials will now be described by way of example only and with reference to the accompanying drawings in which.

Figures 1, 2:
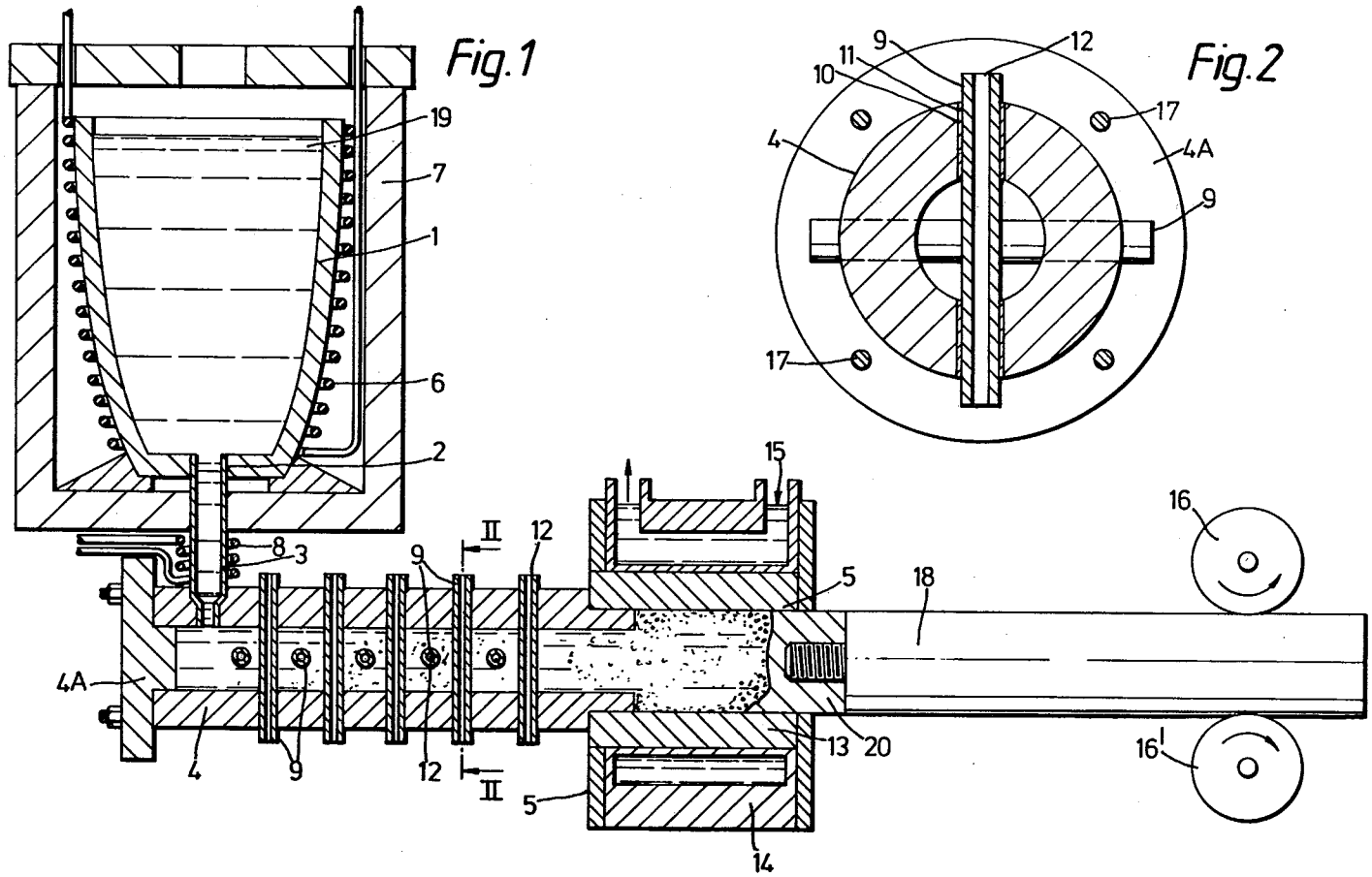
FIG. 1 shows the apparatus in sectional elevation.
FIG. 2 is a sectional elevation on the line II—II of FIG. 1, through a slurry-making duct in the form of a tube forming part of the apparatus of FIG. 1.

The apparatus of FIG. 1 comprises a vessel 1 for holding molten material, the vessel having an outlet 2 through which it communicates with the upper end of a short downpipe 3. At its lower end the downpipe opens into a duct in the form of a slurry-making tube 4. The slurry making tube is substantially horizontally disposed and opens at the end farthest from the downpipe into a die 5 forming part of a continuous casting machine.

The holding vessel 1 is heated by radiant elements 6 so as to maintain its charge at the desired temperature and is enclosed in a chamber shown somewhat schematically at 7 to prevent it being subject to draughts. The downpipe too is preferably heated at least initially during a casting run so as to prevent the molten material first entering the downpipe from freezing. A coiled heater element 8 may be used for this purpose.

The slurry-making tube 4 is provided with a number of transversely disposed rods 9 passing through apertures 10 drilled in the tube walls (FIG. 2). The rods are sealed into the apertures by a layer of cement 11. The rods are hollow having a passageway 12 through them through which a coolant can be circulated by means not shown in the drawings. Alternate rods are mutually disposed at right angles.

The cooler die 5 of the continuous casting machine comprises an annular graphite block 13 aligned with the end of the slurry-making tube and into which the tube end projects making a tight fit with the block. The slurry-making tube is held firmly to the block of the continuous casting machine by means of tie bars 17 secured to the block 13 at one end and at their other ends passing through apertures in the end plate 4A of the slurry-making tube and carrying nuts on a threaded portion which nuts can be tightened against plate 4A. To allow for linear expansion of the tube in use springs are provided between each nut and the face of the end plate 4A. The block 13 of the continuous casting machine is surrounded by an annular water jacket 14 eg of copper, shrink-fitted to the graphite block for good thermal contact and provided with inlet and outlet so that a stream of cooling water 15 can be circulated therethrough. The continuous casting machine also has a pair of pinch rollers 16, 16' arranged in line with the aperture in the die 5 and driven by an electric motor not shown.

In use, the cooling water circulation through the jacket 14 is started and a starter bar 18 inserted into the aperture in the die 5. The rear end of the bar engages between pinch rollers 16, 16'. The downpipe heater 8 is switched on and the pipe heated up to an appropriate temperature. Likewise it may be convenient to preheat the cooling/stirring rods using heated wires passed through the rods preliminary to a casting run. These are withdrawn and the cooling means (if any) connected up just prior to allowing the material to be cast to enter the slurry-making tube. A molten metal alloy 19 which exhibits a freezing range of temperatures is poured into the holding vessel 1 and after a delay which is calculated or measured in a calibration run, the supply of coolant (if any) to the cooling/stirring rods is commenced and the rollers 16, 16' are started to turn, thus drawing the starter bar out of the die and away from the slurry-making tube. As the molten metal passes down the down tube 3 and along the slurry-making tube 4 it is cooled and solid commences to form in the liquid metal, so that a metallic slurry is generated. As the metallic material passes in this state into the cooler die of the continuous casting machine complete solidification results and the solidified material 20 attaches to the starter bar 18 and is steadily withdrawn thereby until the solidified material itself is engaged between the pinch rollers 16, 16'. After this point is reached the starter bar may be detached from the solid material though this is preferably done by first cutting off the end portion of the solidified material together with the bar and then either melting that material off the bar or otherwise removing it.

As an illustration of actual operating conditions for the process of the invention, an apparatus of the type generally described and illustrated hereinbefore which was designed for the casting of an aluminium alloy by way of a slurry will now be described by way of example only. The apparatus was designed to produce continuously cast aluminium bar at a rate of 75 Kg/hour using as a part of the apparatus a continuous casting machine.

Molten aluminium alloy LM4 (B.S.1490) was supplied from the holding vessel 1 where it was maintained at a temperature of 660° C. Alloy of this type has a freezing temperature range of from 611° C. to 520° C. The molten alloy was allowed to pass freely through the outlet 2 in the bottom of the vessel 1 and down the uninsulated downpipe 3 which was 440 mm long and of 18 mm internal diameter into one end of the horizontally disposed slurry-making tube 4. At the bottom of the downpipe the temperature of the alloy was measured as 640° C. The slurry-making tube was constructed of GC50 refractory ceramic material which is a silica fibre-strengthened alumina composition and was 425 mm long with an internal diameter (id) of 38 mm and a minimum wall thickness of 29 mm. Disposed across the tube were ten hollow graphite cooling rods, each 96 mm long and with 5 mm id and 15 mm od. The rods were disposed perpendicular to the axis of the tube with alternate rods at right angles to each other and were each spaced apart longitudinally of the tube by 20 mm. The rods were connected to an air supply line so that a controlled volume of air could be blown through them, by means of flexible hoses terminating in copper tubes which fitted tightly into the rod ends. In the run being described air was blown through the last two rods only, through the ninth rod at a pressure of 10 psi and through the tenth rod at a pressure of 30 psi, and the temperature of the alloy measured just down-stream of the tenth rod was 592° C. The slurry was fed to a continuous casting machine designed to produce bar of diameter 69 mm at a rate of 110 mm/minute with a water-cooled graphite die. In the present run the casting rate was 220 mm/minute, but in other runs casting rates in excess of 300 mm/minute have been achieved.

The same apparatus was used to cast aluminium alloy LM24, (B.S.1490) the temperature of which in the holding vessel was 639° C. and which has a freezing temperature range of from 580° C. to 520° C. Cooling was effected by passing air through the final three cooling rods at 5 psi. The alloy casting rate in this case was 200 mm/minute.

I claim:

1. A process for forming shaped articles from a metallic material comprising flowing molten metallic material as a confined stream; heat insulating the external surface of the confined stream; abstracting heat evenly from within and across the body of the heat insulated stream by interrupting the flow of the stream by a plurality of static stirring elements positioned transverse to the stream to produce turbulent flow within the stream, at least one of said stirring elements being a thermal conductor for cooling the interrupted flow such that a solid phase is precipitated from said stream in the form of particles having a fine equiaxed grain structure; and casting the stream outflowing from said static stirring elements such that it solidifies with a substantially non-dendritic microstructure.

2. A process as claimed in claim 1, wherein the metallic material is flowed as a stream through a closed duct having heat insulating sidewalls.

3. A process as claimed in claim 2, wherein the stream is confined within a refractory heat insulating duct.

4. A process as claimed in claim 1, wherein the stream outflowing from the stirring elements is cast in a continuous casting machine to produce a continuous bar.

5. A process as claimed in claim 1, wherein the stream outflowing from the stirring elements is cast in ingot form.

* * * * *